United States Patent [19]

Wolf

[11] Patent Number: 4,741,530

[45] Date of Patent: May 3, 1988

[54] POWER TRAINING ARRANGEMENT

[76] Inventor: Hans-Gerd Wolf, Nittumer Weg 76, 5060 Bergisch Gladbach, Fed. Rep. of Germany

[21] Appl. No.: 886,250

[22] Filed: Jul. 16, 1986

[30] Foreign Application Priority Data

Oct. 31, 1985 [DE] Fed. Rep. of Germany ... 8530853[U]

[51] Int. Cl.[4] ..... A63B 21/22

[52] U.S. Cl. ..... 272/134; 272/118; 272/72; 272/129; 128/25 R

[58] Field of Search ..... 128/25 R, 25 B, 26; 272/73, DIG. 5, DIG. 4, 132, 134, 93, 130, 901, 900, 123, 118, 72, 129

[56] References Cited

U.S. PATENT DOCUMENTS

| | | | |
|---|---|---|---|
| 4,252,314 | 2/1981 | Ceppo | 272/123 X |
| 4,253,662 | 3/1981 | Podolak | 272/123 |
| 4,390,179 | 6/1983 | Szkalak | 272/118 |
| 4,606,538 | 8/1986 | Wang | 272/72 |
| 4,637,607 | 1/1987 | McArthur | 272/129 X |
| 4,650,185 | 3/1987 | Cartwright | 272/129 X |

FOREIGN PATENT DOCUMENTS

| | | | |
|---|---|---|---|
| 2130899 | 6/1984 | Fed. Rep. of Germany | 272/129 |

*Primary Examiner*—Richard J. Apley
*Assistant Examiner*—Howard Flaxman
*Attorney, Agent, or Firm*—Erwin S. Teltscher

[57] ABSTRACT

A power training arrangement includes two moving elements which can be coupled with one another and which are jointly driven by a rotor-slippage electric motor or by a direct current motor. The user of the arrangement can then either brake or accelerate the movements of the two moving elements with his or her muscular force. A tow cable may be connected with one of the moving elements and may transmit periodic forces to a horizontal bar element and particularly to a slide mounted on the horizontal bar element for upward and downward movement and carrying a selected number of weight elements. The construction of the arrangement of the present invention renders it possible to accomplish a dynamic training.

12 Claims, 2 Drawing Sheets

POWER TRAINING ARRANGEMENT

BACKGROUND OF THE INVENTION

The present invention relates to exercise equipment in general, and more particularly to a power training arrangement of the type provided with a driving motor which drives, via a transmission, a moving element which is connected with a gripping member.

For the training of athletes and the rehabilitation of handicapped or incapacitated persons, there are already known various constructions or power training arrangements, in which a moving element is driven by a motor. In such an arrangement, the moving element is provided with a gripping portion or member, which can be engaged by the hand or by the foot of the user of the arrangement, in order to slow down or stop the movement of the moving element. In many instances, the moving element is driven via a crank mechanism, so that it moves at a constant speed of the motor with different velocities at different times, and also the power transmission ratio varies in time. However, such known power training arrangements have the drawback that the individual phases of a movement cycle take different amounts of time, so that the user must adjust himself or herself to the time-varying velocity of movement of the moving element. Moreover, only movements of less than 180° can be performed by the moving element of the power training arrangement, so that an optimum training over the entire movement range (for instance, crossing of arms) is not possible.

Other known power training arrangements are provided with weights which are to be lifted by the user via a transmission mechanism in the various recommended or required ways, or springs which are to be tensioned. Power training arrangements of this variety render it possible, as a rule, to achieve muscle loading only in one direction, while muscle loading in the opposite direction cannot be exercised. At the very least, a fully effective training during a "negative" phase of movement is not possible, since the weight or the loading remains the same, whereas the muscle exerts up to two times the original force during the negative phase. Herein, the term "negative" as applied to phase of movement or to movement means an attempt at maintaining a muscle contraction against a load or a weight.

Thus, it may be seen that the heretofore proposed power training arrangements leave much to be desired in terms of structure but especially in the way in which they can be used to train or rehabilitate the users of such arrangements. Moreover, such known arrangements, more often than not, are rather expensive.

SUMMARY OF THE INVENTION

Accordingly, it is a general object of the present invention to avoid the disadvantages of the prior art.

More particularly, it is an object of the present invention to provide a power training arrangement which does not possess the disadvantages of the known power training arrangements.

Still another object of the present invention is to develop a power training arrangement of the type here under consideration, which would lend itself for use in versatile muscle training.

It is yet another object of the present invention to construct the arrangement of the above type in such a manner that the full driving force of the driving motor is transmitted to the moving element at all times, so that the muscle being trained is loaded to a sufficient extent during the negative phase.

A concomitant object of the present invention is to design the above arrangement in such a manner as to be relatively simple in construction, inexpensive to manufacture, easy to use, and yet highly reliable in operation.

In keeping with these objects and others which will become apparent hereafter, one feature of the present invention resides in a power training arrangement which comprises a support; a moving element mounted on the support for movement in a predetermined path and including a gripping member; and means for moving the moving element in the predetermined path, including a regulated reversible motor including an output member, means for controlling the operation of the reversible motor, and a proportional transmission which proportionally transmits the movement of the output member of the reversible motor to the moving element. Advantageously, the reversible motor is either a rotor-slippage electric motor, or a direct current electric motor. The power training arrangement of the present invention as described so far has the advantage that, due to the provision of the controlling means, which is preferably constructed as electronic equipment, it is possible to control the operation of the driving motor electronically with respect to the muscle group to be trained so as to adhere to a predetermined regime.

In the power training arrangement of the present invention, the motor output force is transmitted via a proportional transmission to the moving elements, which is thus driven with a torque that remains constant over time, and which pivots or turns about a stationary axis. The motor can be controlled with respect to its speed of operation or number of revolutions per minute, in order to select various speeds of movement of the moving element. The user of the arrangement then has the choice to act with his or her musculature on the gripping member of the moving element in such a manner as to either enhance the motor-caused movement of the moving element, or to counteract such motor-caused movement (negative phase). Inasmuch as the motor is a regulated rotor-slippage motor or direct current motor, its speed of operation can be varied within predetermined limits by the force exerted by the user. Consequently, the user is able to retard or accelerate the movements of the moving element with his or her muscle force. For the protection of the user, the sense of rotation of the motor can be reversed in response to the action of respective end switches at the very latest when the moving element has reached a certain angular position. In this manner, there is accomplished a cyclical reversal of the movement of the moving element, which is otherwise caused by the electronic control means. In this manner, the user can stress his or her musculature alternatingly in the positive and in the negative phase while maintaining his or her body position.

It is also possible to accomplish a regulation of the speed of operation of the motor in order to perform the movements of the moving element either with a different constant speed or with a speed which changes in dependence on the region of operation of the muscle being trained. To this end, the motor output shaft or the transmission can be provided with a tachogenerator which generates a signal corresponding to the actual speed of operation of the motor, and this actual speed is then compared with a signal representative of the desired speed of the motor. A control signal is then produced from the difference between the values of such actual and desired speed signals, this control signal then controlling the electric current supplied to the motor in such a sense that the motor speed of operation corresponds to the desired speed of operation independently of the applied muscular force. The applied muscular force may be indicated by a display or indication device. The signal of the display or indicating arrangement can be derived from the electric current consumption of the motor by means of a measuring transmitter, sensor or transducer capable of measuring the loading of the motor, or it can be derived from a torque measuring apparatus.

According to another advantageous concept of the present invention, the power training arrangement comprises a support; two moving elements, each mounted on the support for movement in a different predetermined path and including a gripping member; and means for moving the moving elements in the predetermined paths thereof, including a motor including an output member, means for controlling the operation of the motor, and a transmission including two output shafts each of which transmits the movement of the output member of the motor to one of the moving elements. In this manner, it is possible for the user to simultaneously train both of his or her arms, in that each of the arms engages a different one of the two moving elements. Advantageously, these two moving elements are driven in opposite senses and with the same phase relative to one another. This means that the moving elements extend parallel to one another in their lower and upper positions, and point in different directions between these end positions.

The transmission may advantageously include a first and a second gear each mounted on one of the output shafts for joint rotation therewith and for meshing with the respective other gear. Then one of the output shafts is mounted on the support for axial displacement, together with that one of the gears which is mounted thereon, for disengaging the one gear from the gear which is mounted on the respective other shaft, and for removing the moving element of the one shaft from the predetermined path of movement of the moving element of the the respective other shaft. This particular construction renders possible a selective utilization of only one of, or of both, of the moving elements. Now, when only one of the moving elements is being used, then the other moving element is uncoupled from this active moving element and, as a result, it is no longer driven by the motor. On the other hand, the uncoupled moving element is brought into its inactive position, in which it does not present a disturbing appearance.

It is further advantageous when, in accordance with another advantageous facet of the present invention, there is provided a power training arrangement which comprises a support; a moving element mounted on the support for movement in a predetermined path and including a gripping member; means for moving the moving element in the predetermined paths thereof, including a motor including an output member, means for controlling the operation of the motor, and a transmission which transmits the movement of the output member of the motor to the moving element; a horizontal bar component; a slide mounted on the horizontal bar component for vertical movement; at least one deviating roller rotatably mounted on one of the support and the horizontal bar component; a tow cable trained about the deviating roller and having two end portions; and means for connecting one of the ends of the tow cable to the slide and the other of the ends to the moving element. As a result of the provision of the tow cable, the movement of the moving element is transmitted to the slide, which is then periodically lowered and lifted on the vertical posts of the horizontal bar component. The user of the arrangement can then act on this slide with his or her arms or legs, in order to either maintain the slide in position against the effect of the motor movement, or to lift the slide while supporting the effect of the movement of the motor. In this context, it is advantageous when the slide is constructed as a weight carrier and when there is further provided at least one weight selectively carried by the slide. Inasmuch as the motor causes the position of the slide to periodically change, the muscle movements are performed in various stretch conditions. It is also possible to press the slide upwardly with the shoulders, while simultaneously stretching or exercising the leg muscles.

Advantageously, the power training arrangement further comprises a bench arranged underneath the horizontal bar component. It is also advantageous when there is further provided a cable deviating device disposed at a lower region of the horizontal bar component, an additional tow cable having one end connected to the slide and another end remote from the slide, the additional tow cable being trained about the cable deviating device, and a handgrip secured to the other end of the additional tow cable and enabling the user of the arrangement to pull the other end of the additional tow cable upwardly or at an incline against the force exerted by the motor.

Last but not least, the power training arrangement is advantageously so constructed that the support includes a housing which accommodates the motor and the transmission and has a front wall, and the transmission includes at least one output shaft extending tnrough the front wall. Then, there is further provided a seat guide track arranged in front of the front wall and extending parallel to the front wall, and a seat displaceably supported on the guide track. Especially in this connection, it is advantageous when the horizontal bar component is rigidly connected to the housing and extends transversely with respect to the front wall.

The power training arrangement of the present invention renders it possible to perform numerous different exercises, in positions which may vary with time. This arrangement is particularly suited for rehabilitation purposes.

BRIEF DESCRIPTION OF THE DRAWING

The present invention will now be discussed in more detail with reference to the accompanying drawing in which.

DETAILED DESCRIPTION OF THE PREFERRED EMBODIMENT

Figure 1:
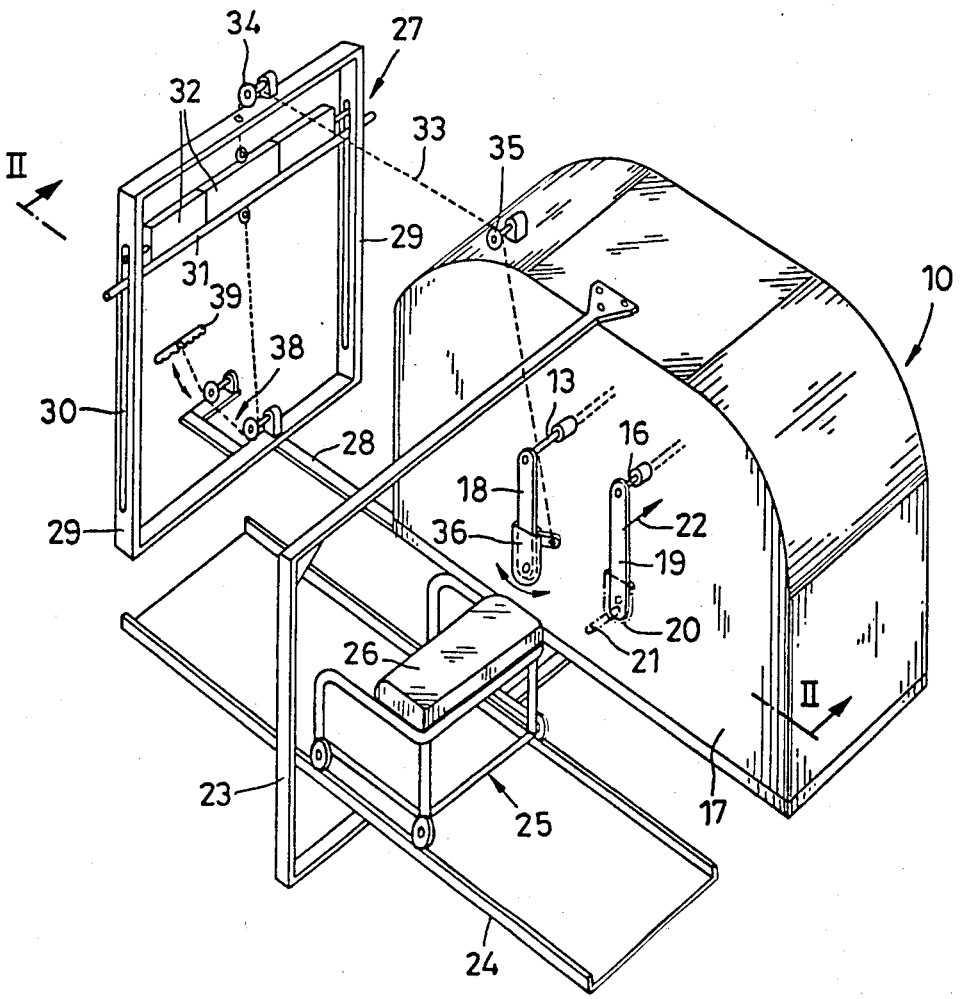
FIG. 1 is a perspective view of a power training arrangement of the present invention.
Figure 2:
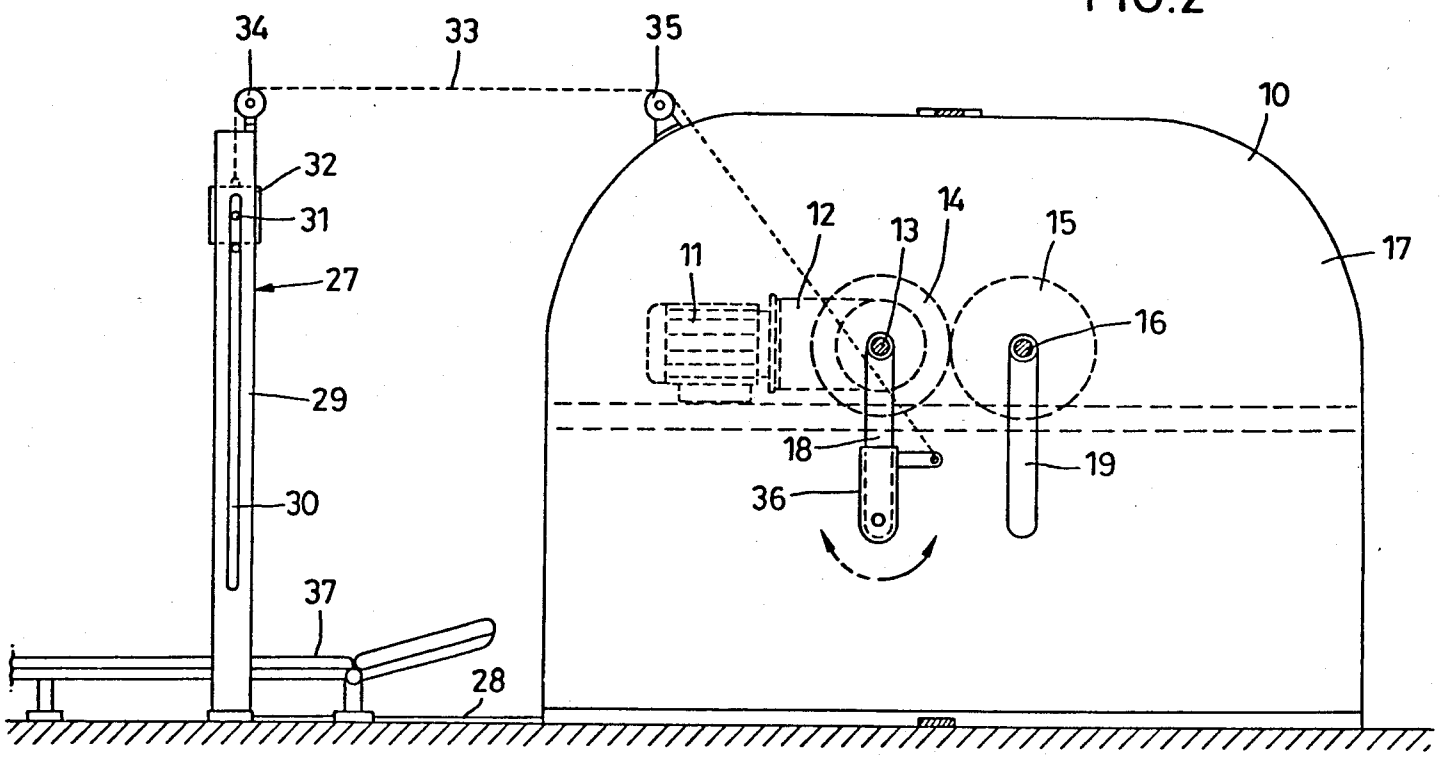
FIG. 2 is a partially sectioned front elevational view taken in the direction of the line II—II of FIG. 1, but showing a somewhat modified construction of the power training arrangement.

Referring now to the drawing in detail, and first to FIG. 1 thereof, it may be seen that the reference numeral 10 has been used therein to identify a housing of a power training arrangement, which is adapted to stand on a floor or any other horizontal support surface in the position illustrated in the drawing. The housing 10 is substantially rectangular in top plan view and accommodates a driving motor 11 and a transmission 12. The transmission 12 drives a first output shaft 13 which is rotatably mounted in the housing 10 and carries a spur gear 14 (see FIG. 2) which is connected to the first output shaft 13 for joint rotation therewith, for instance, by a key, by a spline or a plurality of splines, or the like. As also illustrated in FIG. 2, this spur gear 14 meshes with another spur gear 15 which is mounted for rotation about a common axis on a second output shaft 16. The two output shafts 13 and 16 extend parallel to one another and are arranged at the same elevation above the horizontal support surface in the illustrated position of the power training arrangement. Free end portions of the output shafts 13 and 16 project outwardly of a front wall 17 of the housing 10.

A first moving element 18 is secured to the free end portion of the first output shaft 13. The first moving element 18 has the form of a lever which extends from the first output shaft 13 substantially perpendicular to the axis of the first output shaft 13. A second moving element 19 is secured to the output shaft 16 in an analogous manner. A gripping member 20 may be mounted on each of the moving elements 18 and 19. The gripping member 20 is shown to be constituted by a slide sleeve, from which there extends an arm 21 which extends substantially parallel to the respective output shaft 13 or 16. The slide sleeve of the gripping member 20 is fixed to the respective moving element 18 or 19 by means of a screw which is not illustrated in any particular detail in the drawing. The gripping member 20 has the purpose of being gripped by, for instance the hand of, the user of the power training arrangement, in order to exert muscular force on the respective output shaft 13 or 16.

The second output shaft 16 is axially shiftable in and opposite to the direction of an arrow 22 which is indicated in FIG. 1 of the drawing. Thus, the second output shaft 16 can be displaced more into the housing 10 in the direction of the arrow 22 in order to shift the other spur gear 15 out of meshing engagement with the one spur gear 14. In the inwardly displaced position of the second output shaft 16, which is indicated in FIG. 1 of the drawing, the second moving element 19 is not being driven and, simultaneously, it is removed out of the trajectory of movement of the first moving element 18. When the second moving element 19 is in its operating position, the two moving elements 18 and 19 are driven in opposite directions or senses. The motor 11 is operated in such a manner that the two moving elements 18 and 19 respectively move through an angle of about 180°. A non-illustrated end switch of any known construction is actuated when the respective end position is reached, and the direction of rotation of the motor 11 is reversed in response to such actuation.

The moving elements 18 and 19 are illustrated in FIG. 1 in their lower end positions, even though the moving element 19 is shown in its inactive condition. The user of the power training arrangement can grip the gripping members 20, which may be mounted on each of the moving elements 18 and 19, with both of his or her hands, in order to counteract the movements of the moving elements 18 and 19 with the force exerted by his or her muscles. As a result of the reciprocating movements of the moving elements 18 and 19, there is alternatingly achieved a positive and a negative muscle stressing, that is, the very same muscle or group of muscles alternatingly acts in a braking and in an accelerating manner on the respective movement element 18 or 19.

An auxiliary frame 23 is mounted in the front of the front wall 17 of the housing 10 of the power training arrangement. The auxiliary frame 23 is provided, in the vicinity of the floor or other horizontal support surface in the illustrated position of the power training arrangement, with a guiding track 24 for a movable carriage 25. The movable carriage 25 carries a seat 26 and it can be arrested, by a non-illustrated arresting device of any known construction, in one of a plurality of different positions along the guide track 24. Thus, the user of the power training arrangement is seated at a distance frontwardly of the front wall 17 of the housing 10 and can adjust the position of the seat 26 which is best suited for the respective exercise by moving the carriage 25 along the guide track 24. Inasmuch as the auxiliary frame 23 is secured to the housing 10, the reaction force applied by the user of the power training arrangement to the seat 26 is transferred via the carriage 25, the guide track 24, and the auxiliary frame 23 to the housing 10 of the power training arrangement. Therefore, it is not necessary to individually positionally fix the individual parts of the power training arrangement on the floor or other horizontal support surface, because all forces encountered during the use of the power training arrangement are accepted and transmitted by the power training arrangement itself.

The power training arrangement is further provided with a horizontal bar component 27 which is arranged laterally next to the housing 10 of the power training arrangement and is rigidly connected with such housing 10 by means of at least one connecting bar 28. The horizontal bar component 27 consists of a rigid rectangular frame including two vertical columns 29, each of which is provided with a vertical guiding slot 30. One end of a horizontally extending slide bar 31 is received in each of the slots 30. The slide bar 31 is constructed as a weight carrier. Corresponding associated weights, which may be exchangeably mounted as desired in the slide bar 31, are indicated by the reference numeral 32.

In the kind of use of the power training arrangement of the present invention which is illustrated in FIG. 2 of the drawing, one end of a tow cable 33 is connected to a weight 32 supported on the slide 31. The tow cable 33 is trained about a diverting roller or pulley 34 which is turnably mounted on a transverse horizontal upper bar of the horizontal bar component 27, and about a guiding roller or pulley 35 which is turnably mounted on the housing 10 of the power training arrangement, and extends all the way toward, and is connected to, a holder 36 which is removably mounted on the first moving element 18. When the first moving element 18 is pivoted by the turning of the first output shaft 13, the slide 31 is lifted or lowered in the horizontal bar component 27, depending on the sense and extent of turning of the first output shaft 13. The point of attachment of the tow cable 33 to the moving element 18 via the holder 36 is chosen in such a manner that the slide 31 performs a complete lifting or lowering movement on the horizontal bar component 27 during the movement of the moving element 18 through 180°.

The user of the power training arrangement can then attempt to lift the slide 31 with the weights 32, or to prevent the lowering of the slide 31 with muscular force. Inasmuch as the slide 31 moves in a vertical path, the muscle stressing occurs at different levels.

When the tow cable 33 is being used and when, accordingly, the holder 36 is mounted on the first moving element 18, the second moving element 19 is in its inactive or disengaged position, that is, the second output shaft 16 is displaced into the housing 10, so that the other spur gear 15 is not being driven. In this condition, it is also possible to let the first output shaft 13 to constantly rotate in the same sense or direction of rotation.

As also shown in FIG. 2 of the drawing, a bench 37 is provided on the horizontal bar component 27 underneath the slide 31. The user of the power training arrangement can then use this bench 37 to either lie or sit thereon in order to perform the required exercises.

In the form of use of the power training arrangement of the present invention which is illustrated in FIG. 1 of the drawing, the bench 37 is removed. The tow cable 33 extends from the upper deviating roller or pulley 34 to a lower deviating arrangement 38 which is arranged at the lower region of the horizontal bar component 27, and from there to a handgrip 39. The user of the power training arrangement can engage the handgrip 39 with both of his or her hands, in order to pull the end of the tow cable 33 up.

The user of the power training arrangement can perform, among others, the following exercises on the horizontal bar component 27:

1. Bench pressing; during this exercise, the user of the power training arrangement lies on the bench 37, in order to press with his or her arms against the slide 31.

2. Knee bending; during this exercise, the user of the power training arrangement stands below the horizontal bar component 27, without the bench 37 being present, the user supporting the slide 31 with his or her shoulders and pushing the weights 32 up with bent knees.

3. Back lifting; during this exercise, the user of the power training arrangement stands in front of the horizontal bar component 27, bends forward and lifts the weights 32 upwardly.

4. Leg pressing; during this exercise, the user of the power training arrangement lies on the bench 37 and presses with his or her feet from underneath against the slide 31.

It may be seen that various other exercises may also be performed using the power training arrangement of the present invention, if need be, with other auxiliary implements. The arrangement of the present invention is extremely versatile and renders it possible to stress various muscles in the various positions, in each instance, in bending and extending directions or senses.

While the present invention has been described and illustrated herein as embodied in a specific construction of a power training arrangement, it is not limited to the details of this particular construction, since various modifications and structural changes are possible and contemplated by the present invention. Thus, the scope of the present invention is to be determined exclusively by the appended claims.

What is claimed is:

1. A power training arrangement comprising in combination a support, a moving element mounted on said support for movement in a predetermined path and including a gripping member, means for moving said moving element in said predetermined direction, including a motor including an output member, means for contolling the operation of said motor, and a transmisstion which transmits the movement of said output member of said motor to said moving element, a horizontal bar component;

a slide mounted on said horizontal bar component for vertical movement, at least one deviating roller rotatably mounted on one of said support and said horizontal bar component, a tow cable trained about said deviating roller and having two end portions, means for connecting one of said ends of said tow cable to said slide and the other of said ends to said moving element, a cable deviating device disposed at a lower region of said horizontal bar component, an additional tow cable having one end connected to said slide and another end remote from said slide, said additional tow cable being trained about said cable deviating device, and a handgrip secured to said other end of said additional tow cable and enabling the use of the arrangement to pull said other end of said additional tow cable upwardly against the force exerted by said motor.

2. The power training arrangement as defined in claim 1, wherein said motor is a regulated reversible motor.

3. The power training arrangement as defined in claim 1, further comprising an additional moving element mounted on said support for movement in another path different from said predetermined path, said additional moving element containing an additional gripping member, said transmission including two shafts, each of which transmits the movement of said output member of said motor to a different one of said moving elements.

4. The power training arrangement as defined in claim 1, wherein said slide is constructed as a weight carrier; and further comprising at least one weight selectively carried by said slide.

5. The power training arrangement as defined in claim 1, and further comprising a bench arranged underneath said horizontal bar component.

6. The power training arrangement as defined in claim 1, wherein said support includes a housing which accommodates said motor and said transmission and has a front wall, and said transmission includes at least one output shaft extending through said front wall; and further comprising a seat guide track arranged in front of said front wall and extending parallel to said front wall, and a seat displaceably supported on said guide track.

7. The power training arrangement as defined in claim 1, wherein said horizontal bar component is rigidly connected to said housing and extends transversely with respect to said front wall.

8. The power training arrangement as defined in claim 2, wherein said reversible motor is a rotor-slippage electric motor.

9. The power training arrangement as defined in claim 2, wherein said reversible motor is a direct current electric motor.

10. The power training arrangement as defined in claim 2, wherein said support includes a housing which accommodates said motor and said transmission and has a front wall, said transmission including at least one output shaft extending through said front wall; and further comprising a seat guide track arranged in front of said front wall and extending parallel to said front wall; and a seat displaceably supported on said guide track.

11. The power training arrangement as defined in claim 3, wherein said transmission includes a first and a second gears each mounted on a different one of said output shafts for joint rotation therewith and for meshing with the respective other gear; wherein one of said output shafts is mounted on said support for axial displacement, together with that one of said gears which is mounted thereon, for disengaging said one gear from said gear which is mounted on the respective other shaft, and for removing said moving element of said one shaft from said predetermined path of movement of said moving element of said respective other shaft.

12. The power training arrangement as defined in claim 3, wherein said support includes a housing which accommodates said motor and said transmission and has a front wall, said output shafts extending through said front wall; said further comprising a seat guide track arranged in front of said front wall and extending parallel to said front wall, and seat displaceably supported on said guide track.

* * * * *